US007143678B2

(12) United States Patent
Callow

(10) Patent No.: US 7,143,678 B2
(45) Date of Patent: Dec. 5, 2006

(54) CUTTING MACHINE FOR BRICK MAKING

(75) Inventor: Christopher Charles Norris Callow, Bendigo (AU)

(73) Assignee: Boral Bricks (NSW) Pty. Ltd., Moorebank (AU)

( * ) Notice: Subject to any disclaimer, the term of this patent is extended or adjusted under 35 U.S.C. 154(b) by 0 days.

(21) Appl. No.: 09/870,135

(22) Filed: May 30, 2001

(65) Prior Publication Data

US 2002/0056356 A1 May 16, 2002

(30) Foreign Application Priority Data

May 30, 2000 (AU) ..... PQ7839

(51) Int. Cl.

| | |
|---|---|
| ***B26D 1/553*** | (2006.01) |
| ***B26D 3/06*** | (2006.01) |
| ***B26D 11/00*** | (2006.01) |
| ***B28B 11/12*** | (2006.01) |
| ***B28B 11/14*** | (2006.01) |

(52) U.S. Cl. ..... 83/862; 83/425.3; 83/651.1; 83/857; 83/858; 83/865; 83/875; 425/301

(58) Field of Classification Search ..... 83/52, 83/56, 171, 425, 425.1, 425.2, 425.3, 425.4, 83/432, 614, 620, 651.1, 856, 857, 858, 862, 83/865, 875; 264/138, 146, 157, 158; 425/301, 425/302.1, 303, 306, 307, 311

See application file for complete search history.

(56) References Cited

U.S. PATENT DOCUMENTS

| | | | | | |
|---|---|---|---|---|---|
| 608,368 | A | * | 8/1898 | Lawson | 83/425.3 |
| 1,122,704 | A | * | 12/1914 | Dunn | 83/307.2 |
| 1,663,106 | A | * | 3/1928 | Warfield | 264/680 |
| 1,735,497 | A | * | 11/1929 | Duty | 264/162 |
| 2,015,681 | A | * | 10/1935 | Kesty | 264/163 |
| 2,103,802 | A | * | 12/1937 | Ullrich | 425/96 |
| 2,321,188 | A | * | 6/1943 | Doering et al. | 426/663 |
| 2,907,129 | A | * | 10/1959 | Bedell | 118/35 |
| 3,059,306 | A | * | 10/1962 | Hamilton | 83/862 |
| 3,216,474 | A | * | 11/1965 | Popeil | 83/651.1 X |
| 3,695,129 | A | * | 10/1972 | Vrijma | 83/614 X |
| 4,137,807 | A | * | 2/1979 | Schaumberg | 83/651.1 X |
| 4,221,148 | A | * | 9/1980 | Lewis | 83/869 |
| 4,300,429 | A | * | 11/1981 | Brown et al. | 83/651.1 |
| 4,328,724 | A | * | 5/1982 | Lingl | 83/23 |
| 4,419,065 | A | * | 12/1983 | Cox | 425/301 |
| RE31,479 | E | * | 1/1984 | Lewis | 83/869 |
| 4,646,598 | A | * | 3/1987 | Lineberry et al. | 83/56 |

* cited by examiner

*Primary Examiner*—Clark F. Dexter
(74) *Attorney, Agent, or Firm*—Morgan, Lewis & Bockius LLP

(57) ABSTRACT

A wire-cutting apparatus 10 used in the manufacture of bricks. The apparatus includes a pair of spaced generally parallel coextensive beams 13 and 14 between which cutting wires 15 pass. Associated with each wire 15 are groove-forming blades 27 and 28.

4 Claims, 4 Drawing Sheets

CUTTING MACHINE FOR BRICK MAKING

TECHNICAL FIELD

The present invention relates to cutting machines for brick making.

BACKGROUND OF THE INVENTION

In the manufacture of bricks, a slug is extruded and is delivered to a wire-cutting machine. The slug is moved transversely of its longitudinal length through the wire-cutting machine to slice the slug into individual "green" bricks. The wire-cutting machine includes a frame having top and bottom generally horizontal co-extensive vertically spaced beams between which tensioned wires pass. The wires are generally to parallel and horizontally spaced. The wires pass through the slug so that the slug is transversely sliced into individual "green" bricks.

The above mentioned apparatus has the disadvantage that when a slug is delivered to the wire-cutting apparatus, only "green" bricks having planar faces and sharp edges are formed.

OBJECT OF THE INVENTION

It is the object of tie present invention to overcome or substantially ameliorate the above disadvantage.

SUMMARY OF THE INVENTION

There is disclosed herein a wire-cutting apparatus for brick manufacturing, said apparatus including:

a pair of generally vertically spaced elongated beams held in a generally parallel co-extensive spaced relationship;

a plurality of tensioned spaced slug cutting wires attached to and extending between the beams, the wires being located at spaced locations along the beams; and at least one blade mounted on one of the beams to engage the slug to form a slot in a green brick being formed.

Preferably, the or each blade is mounted adjacent a wire.

Preferably, the or each blade has a passage through which an associated one of the wires passes.

Preferably, the or each blade engages the slug so as to form the slot along a comer of the "green" brick being formed.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
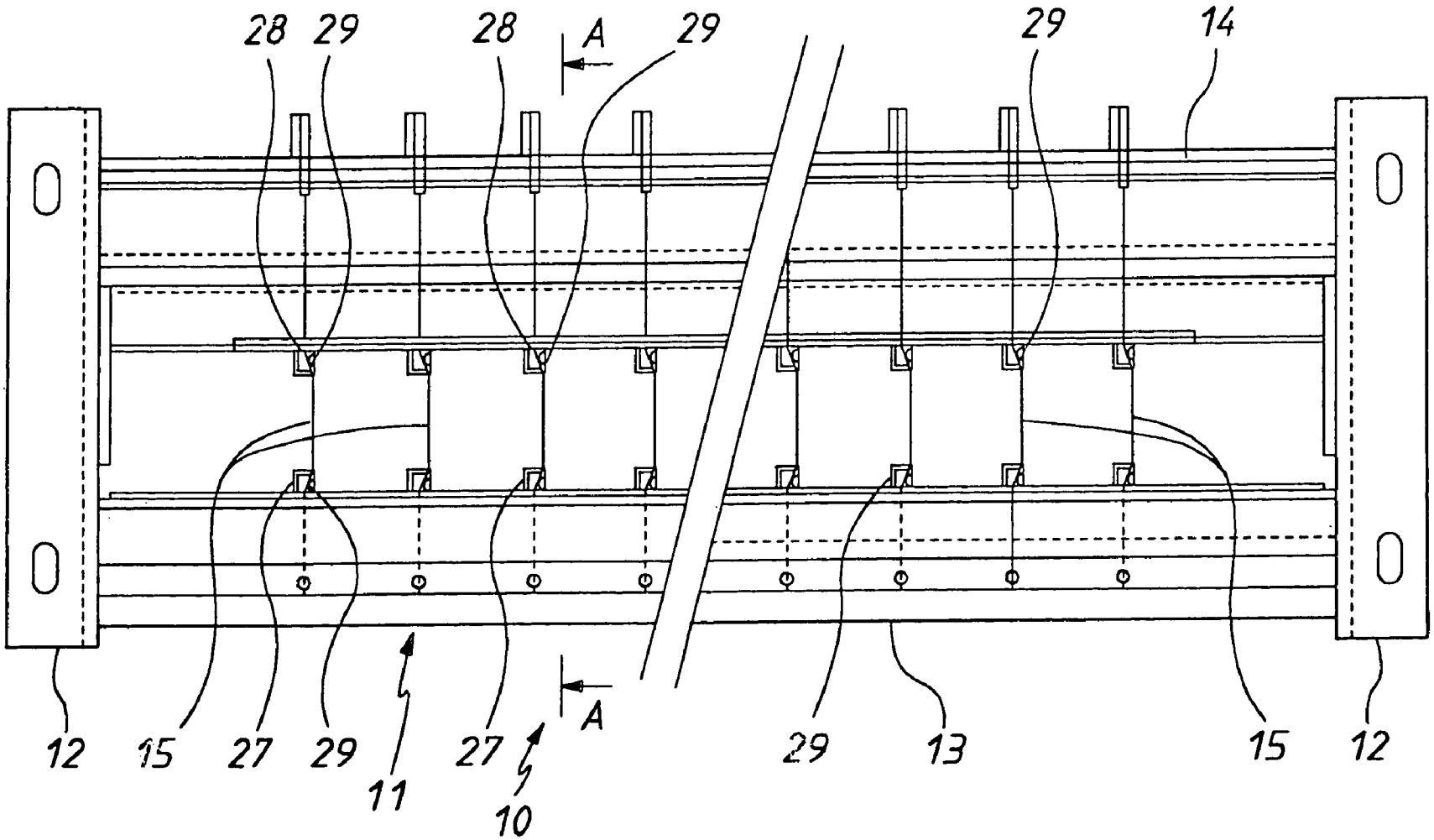
FIG. 1 is a schematic front elevation of a wire-cutting apparatus for brick manufacture.
Figure 2:
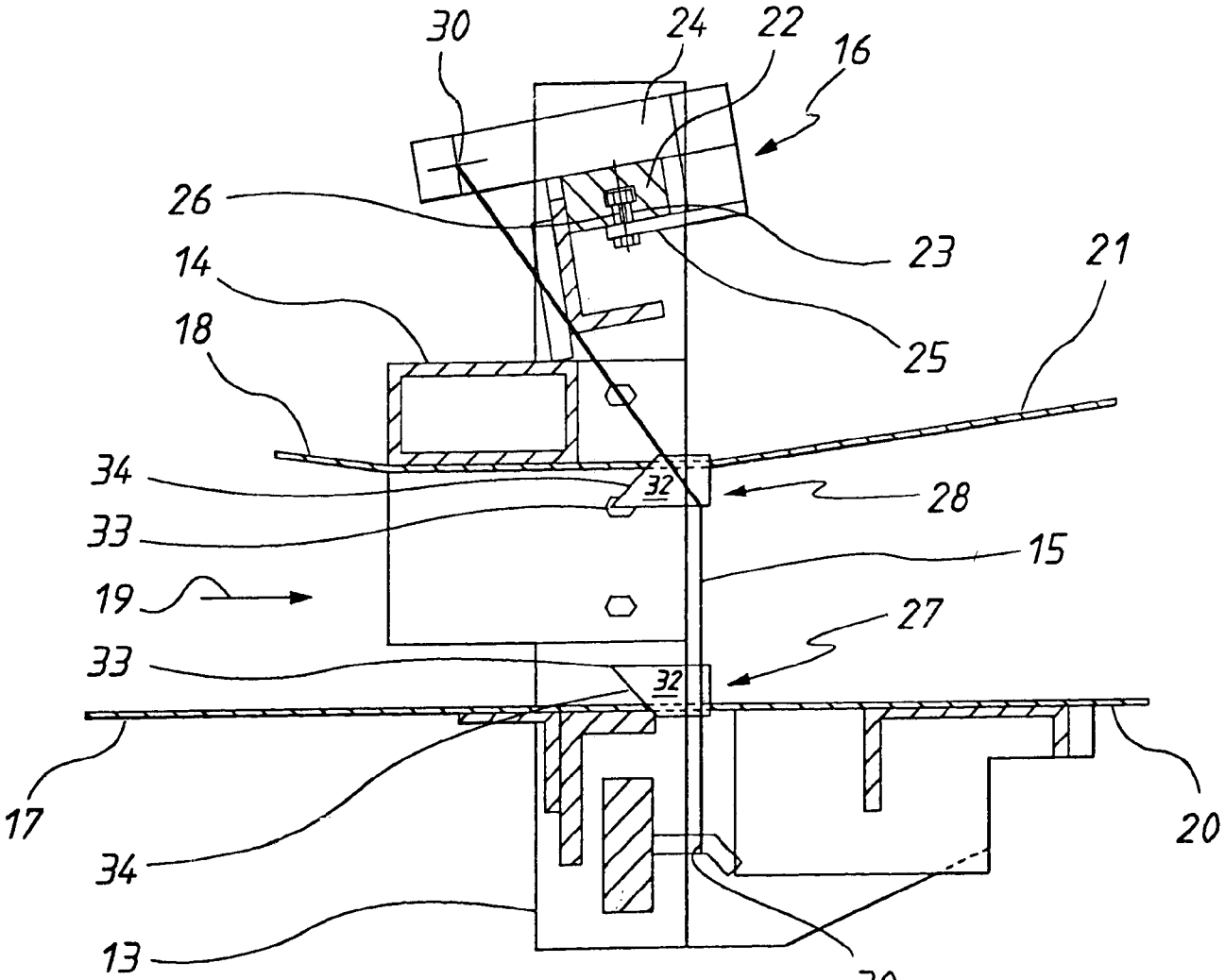
FIG. 2 is a schematic end elevation of the apparatus of FIG. 1 sectioned along the line A—A.
Figure 3:
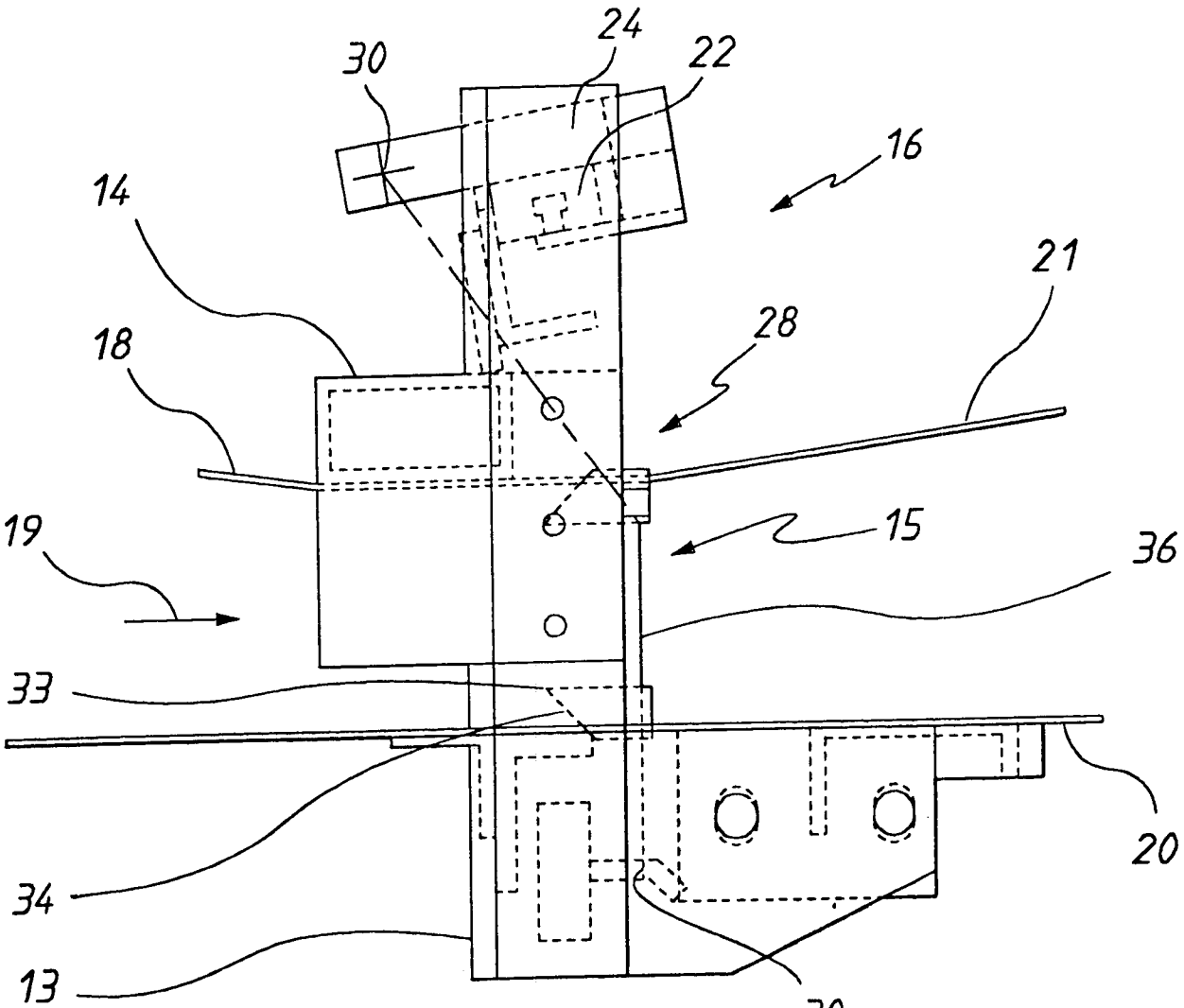
FIG. 3 is a schematic end elevation of the apparatus of FIG. 1.
Figure 5:
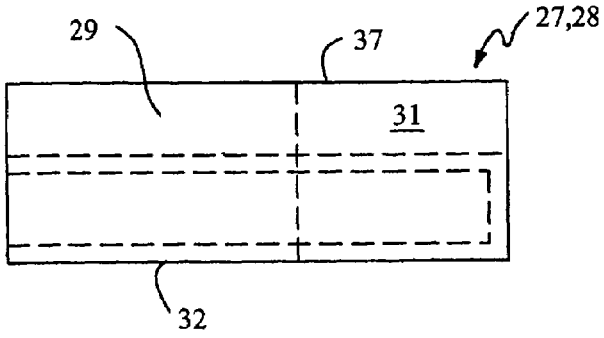
FIG. 5 is a schematic top plan view of the blade of FIG. 4.
Figure 6:
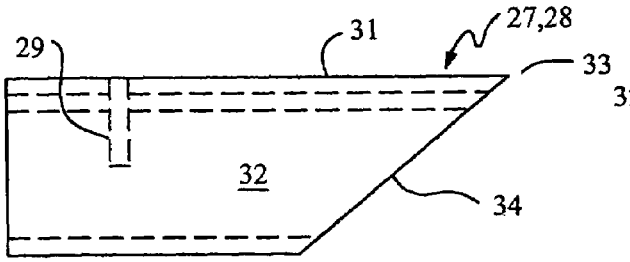
FIG. 6 is a schematic side elevation of the blade of FIG. 4.
Figure 4:
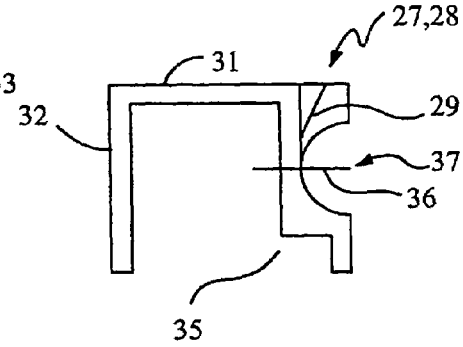
FIG. 4 is a schematic end elevation of a blade employed in the apparatus of FIGS. 1 to 3.

In the accompanying drawings there is schematically depicted a wire-cutting apparatus 10 used in the manufacture of bricks. More particularly the apparatus 10 cuts a clay slug into individual "green" bricks. The slug would be formed by a clay-extruding machine which would deliver the slug to a conveyor. The slug is moved to a position adjacent the apparatus 10 and is then pushed through the apparatus 10 in a direction generally perpendicular to the longitudinal direction of extension of the slug.

The apparatus 10 has a frame 11 including a pair of upright members 12 between which there extends a pair of parallel generally co-extensive beams 13 and 14 which are vertically spaced. Attached to and extending between the beams 13 and 14 are generally vertical cutting wires 15 arranged at equally horizontally spaced locations along the beams 13 and 14. Each wire 15 has its lower extremity fixed to the beam 13, while mounted on the beam 14 are tensioning apparatus 16 to which the upper end of each wire 15 is attached. The apparatus 16 is operable to tension each wire 15 so as to maintain it taut during formation of the "green" bricks.

The apparatus 10 further includes delivery plates 10 further includes delivery plates 17 and 18 along which the slug moves in the direction of the arrow 19 to be cut by the wires 15. The green bricks exit via outlet plates 20 and 21. The plate 21 diverges upwardly relative to the plate 20, while the plate 18 has an inclined entrance portion relative to the plate 17.

The apparatus 16 includes a mounting member 22 which has a longitudinally extending slot 23 of"T" transverse cross-section. Mounted on the member 22 is a tension member 24 having a flange 25 which a slot generally perpendicular to the slot 23. A threaded fastener 26 passes through the slot in the flange 25 to enter the slot 23. A head on the threaded fastener 26 enable the threaded fastener 26 to be tensioned to secure the member 24 in position fixed to the member 22. An extremity of the member 22 has fixed to it the upper end of an associated wire 25. Adjustable movement of the member 24 relative to the member 22 enable tensioning of the wire 15.

Mounted on the lowerbeam 13 are lower blades 27 while mounted on the upper beam 14 are upper blades 28. Each of the blades 27 and 28 has a passage 29 through which the associates wire 15 passes. The passages 29 displace the wire 15 laterally relative to a plane passing through the mounting points 30 that attach each wire 15 to the lower beam 13 and the associated tensioning apparatus 16. That is the wire 15 has a major length 36 displaced laterally relative to the wire portions located within the blades 27 and 28.

Each blade 27 and 28 is of a "U" configuration so as to have a generally planar side wall 32 joined to a shaped side wall 37 by means of a base 31. The base 31 is provided with a leading edge 33 while the side wall 37 and 32 terminate with an inclined face 34. Located between the side wall 37 and 32 is a space 35 through which removed clay passes. Each passage 29 extends diagonally through the side wall 37.

The side wall 37 is provided with an accurate recess 36 which provides an accurate projection on the side of the "green" brick being formed. The base 31 and the side wall 32 form a step in the respective corners of the "green" brick being formed.

The invention claimed is:

1. A wire-cutting apparatus for brick manufacturing, the apparatus including:

a pair of generally vertically spaced elongated beams arranged in a substantially parallel, spaced relationship;

a plurality of tensioned spaced slug cutting wires attached to and extending between the beams, the wires being located at spaced locations along the beams to cut the slugs to form green bricks; and a plurality of blades mounted on one of the beams and disposed between the beams to form slots in the slug, wherein each blade is associated with a corresponding one of the wires, such that a slot is formed at a corner of each green brick being formed, and wherein each of the blades has a passage through which an associated one of the cutting wires passes.

2. The apparatus of claim 1, wherein the blades are mounted on the beams, with the blades being arranged in pairs with each pair including a respective one of the blades on each of the beams and between which an associated one of the cutting wires passes.

3. The apparatus of claim 2, wherein each of the cutting wires has a major length displaced laterally relative to portions of the wire located between the blades.

4. The apparatus of claim 1, wherein each of the cutting wires has a major length displaced laterally relative to portions of the wire located between the blades.

* * * * *